US006471102B2

(12) United States Patent
Hancock

(10) Patent No.: US 6,471,102 B2
(45) Date of Patent: Oct. 29, 2002

(54) BRA SUPPORT

(76) Inventor: Leslie D. Hancock, 6455 Pinehurst Dr., Houston, TX (US) 77023

( * ) Notice: Subject to any disclaimer, the term of this patent is extended or adjusted under 35 U.S.C. 154(b) by 0 days.

(21) Appl. No.: 09/829,575

(22) Filed: Apr. 10, 2001

(65) Prior Publication Data

US 2001/0038022 A1 Nov. 8, 2001

Related U.S. Application Data

(60) Provisional application No. 60/196,120, filed on Apr. 11, 2000.

(51) Int. Cl.[7] ..... D06C 15/00
(52) U.S. Cl. ..... 223/84
(58) Field of Search ..... 223/84

(56) References Cited

U.S. PATENT DOCUMENTS 2,951,621 A * 9/1960 Cheney ..... 223/66
3,837,476 A * 9/1974 Schwartz ..... 206/45.34

* cited by examiner

*Primary Examiner*—Rodney M. Lindsey
*Assistant Examiner*—James G Smith

(57) ABSTRACT

A bra support device having a substantially rigid cup support portion having two concave cup portions, a substantially flat portion connecting said concave cup portions, and a means for retaining a bra in the cup portions. In another embodiment, the bra support device further has a hanging means. In another embodiment, the bra support device has a plurality of openings in the cup support portion. In yet another embodiment, the bra support device has a single concave cup portion.

18 Claims, 2 Drawing Sheets

BRA SUPPORT

This application claims the benefit of Provisional application Ser. No. 60/196,120, filed Apr. 11, 2000.

FIELD OF THE INVENTION

The invention relates to a rigid bra-shaped support device having retention means to hold a bra within the concave portions of the device and further having fixed or removable hinging means permitting the device to be hung on closet rods.

BACKGROUND OF THE INVENTION

Women's brassieres containing padding in the cup regions to provide larger, more well proportioned, and/or smoother shapes to the wearers are commonly available and have gained Increasing popularity. For example, bras referred to as "push-up" models have gained much popularity. A major difficulty with such brassieres is the compressibility and distortability of the padding materials. That is, when such bras are placed in drawers for storage or suitcases for travel, the padding becomes crushed and creased. Thereafter, the creases tend to remain in the bra and when worn under tight or knit clothing show through the clothing. Consequently, the smooth and natural appearance desired from use of the padded bra is defeated.

Hanging devices, such as metal and plastic hangers and hangers containing clips or other fastening means to hold pants and/or skirts, are well known in the prior art. U.S. Design Pat. No. D32,4459 discloses a hanger for hanging both a bra and a panty using two sets of clips. The bra and panty hang independently beneath the hanger. U.S. Pat. Nos. Re36,873 and 3,738,549 similarly may be employed to hang a bra through use of clips. However, none of the aforementioned patents provide any support to the cups of the bras. Consequently, if any of such prior art hangers are used to stole padded bras in a crowded closet, the problem of compression and creasing remains.

Therefore, there remains a need for a device to prevent compression and creasing of the cups of bras during storage, shipment and hanging.

further difficulty with padded bras becomes apparent in the washing and drying process. Generally, when bras are washed, it is suggested that the bra not be dried in an automatic dryer as such drying can decrease the life of the elastic and fabric components of the bra. Consequently, bras are hung to dry, usually hung by a strap over a hook or one of the prior art hangers discussed above. The pads in padded bras tend to absorb significant amounts of water during washing. Although the pads can be lightly squeezed to remove excess water, strong pressure or wringing would distort the shape of the pad and produce undesired wrinkles and creases. If a padded bra is hung to dry on either a hook or prior art hanging hanger, there is no support for the pads, permitting some distortion, e.g., sagging, of the pad during drying.

There is a need, therefore, for a device to assist in maintaining the proper shape of the cups of padded bras during drying.

SUMMARY OF THE INVENTION

It is an object of the present invention to meet the needs discussed above. The present invention provides a device for storage, shipment and/or hanging of a bra such that the cups of the bra are protected from compression and creasing.

More specifically, the device of the present invention comprises a rigid bra shaped structure having means to hold the cup)s of the bra within the concave portions of the rigid structure. One embodiment of the present invention provides a vented hanging device so that a padded bra may be dried while yet maintaining the shape of the pad. The present device further provides either permanent or detachable hanging means so that the bra may be hung from a closet rod or other hanger supports.

DETAILED DESCRIPTION OF THE INVENTION

Figure 1:
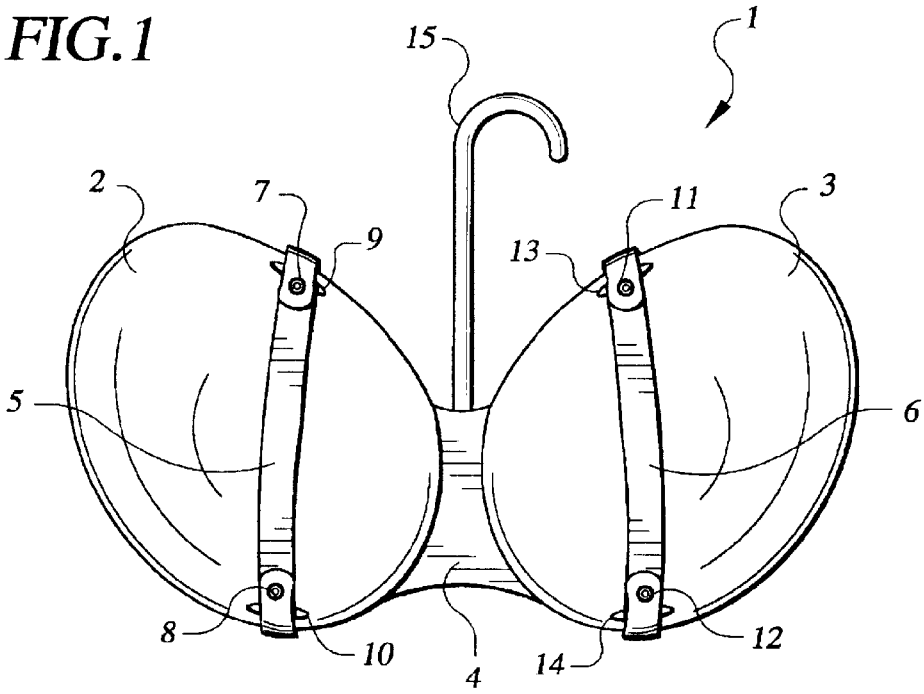
FIG. 1 is a back view of a first embodiment of the bra support of the present invention

Referring first to FIG. 1, a first preferred embodiment of the bra support is comprised of a cup support 1 having two substantially ovoid cup portions, left cup portion 2 and right cup portion 3 joined together by a substantially flat piece 4. Cup portions 2 and 3 extend concavely forward of the plane of flat piece 4. In this first embodiment, a bra is held within said cup support by bands 5 and 6. Band 5 is removably attached across left cup portion 2, extending substantially across a diameter of left cup portion. 2. Similarly, band 6 is removably attached across right cup portion 3, extending substantially across a diameter of right cup portion 3. As shown in FIG. 1, band 5 has two snap closures 7 and 8, one located on each end of band 5. Band 5 is removably attached to left cup portion 2 by passing one end of band 5 through an opening 9 placed on an upper edge of left cup portion 2 and by passing a second end of band 5 through an opening 10 placed on a lower edge of left cup portion 2. Similarly, band 6 has two snap closures 11 and 12. Band 6 is removably attached by passing one end of band 6 through an opening 13 located on an upper edge of right cup portion 3 and by passing a second end through an opening 14 located on a lower edge of right cup portion 3. It will be understood that bands 5 and 6 could be removably attached across the left and right cup portions; respectively using a number of mechanisms known in the art such as attachment by way of hook and loop material strips. In an alternative embodiment, bands 5 and 6 may be fixedly attached across the left and right cup portions 2 and 3 respectively by any of a number of known adhesives or adhesive mechanisms. In the preferred embodiment, bands 5 and 6 are made from elastic material but may alternatively be made of any of a number of non-stretchable or stretchable materials such as cotton or polyester. Cup support 1, including flat portion 4 and cup supports 2 and 3 may be formed from any of a number of rigid plastics. In the preferred embodiment, cup support 1 is either vacuum formed or injection molded from a rigid plastic, such as high-density polyethylene.

Figure 2:
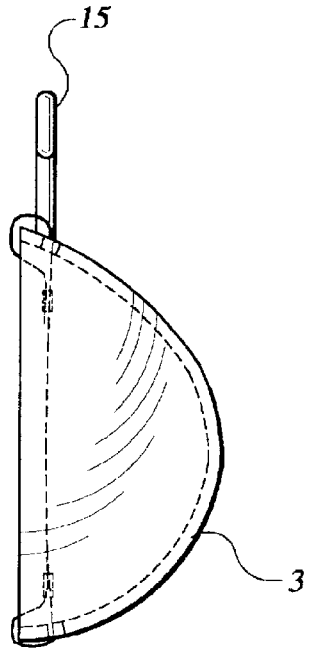
FIG. 2 is a side view of a first embodiment of the bra support of the present invention.

The bra support of the first embodiment of the present invention further has a hanging hook 15 attached to flat portion 4 so at to permit the bra support to be hung on a closet rod, coat hook or other hook means. Hanging hook 15 may be attached to flat portion 4 either removably or fixedly through any of a number of known means. For example, hanging hook 15 may be integrally molded onto flat portion 4 and would, in such case, be permanently attached to flat portion 4. Alternatively, hanging hook 15 could be composed of a metal material and attached either permanently or removably to flat portion 4, preferably at or near a top edge of flat portion 4. Hanging portion 15 may be removably attached to flat portion 4 by any of a number of means known in the art, such as by else of clips or flanged inserts and slots. Referring now to FIG. 2, the concavity oi cup portions 2 and 3 can be more clearly seen.

Figure 3:
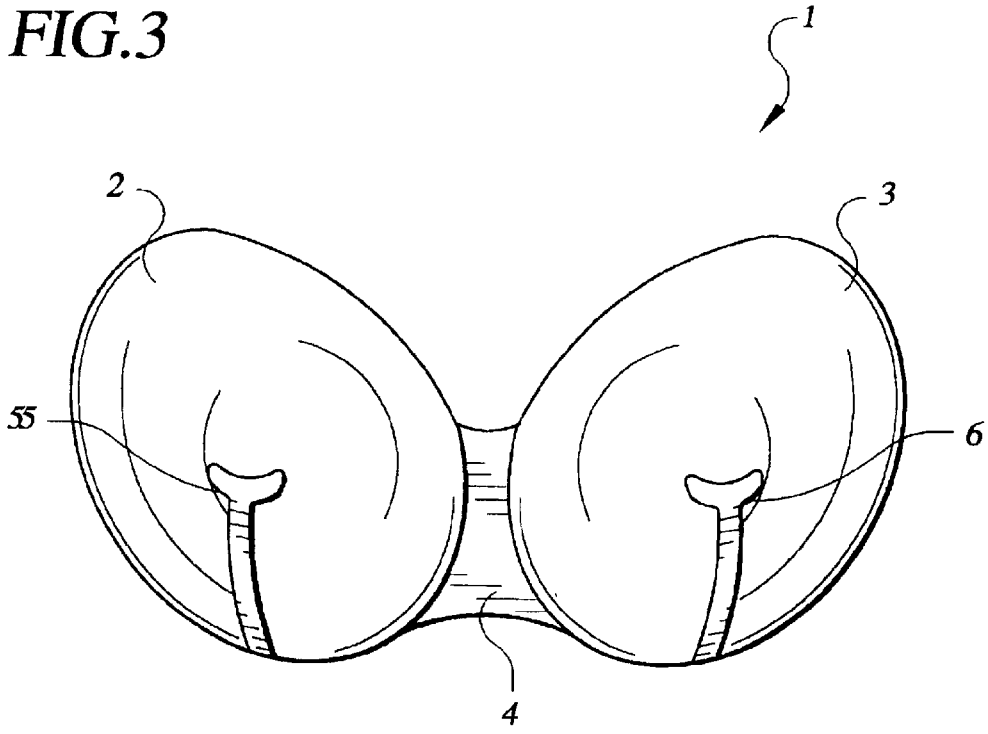
FIG. 3 is a back view of a second embodiment of the bra support of the present invention showing an alternative bra retention means.

Referring now to FIG. 3, an alternative means for retention of a bra within cup supports 2 and 3 is shown. In this second embodiment of the bra support of the present invention, clips 16 and 17 are used to hold the cups of a bra within the concave cup portions 2 and 3. Clips 16 and 17 may be formed as cut out portions of cup support 1, as shown in FIG. 3. In the alternative, clips 16 and 17 may be separate pieces attached to either the lower or upper edges of cup portions 2 and 3, respectively. In such alternative configuration, clips 16 and 17 are attached so as to cause them to press into the concave portions of cup portions 2 and 3, respectively. Clips 16 and 17 can be comprised of any of a number of known rigid plastics. In the second preferred embodiment, as shown in FIG. 3, clips 16 and 17 are made of high density polyethylene.

Figure 4:
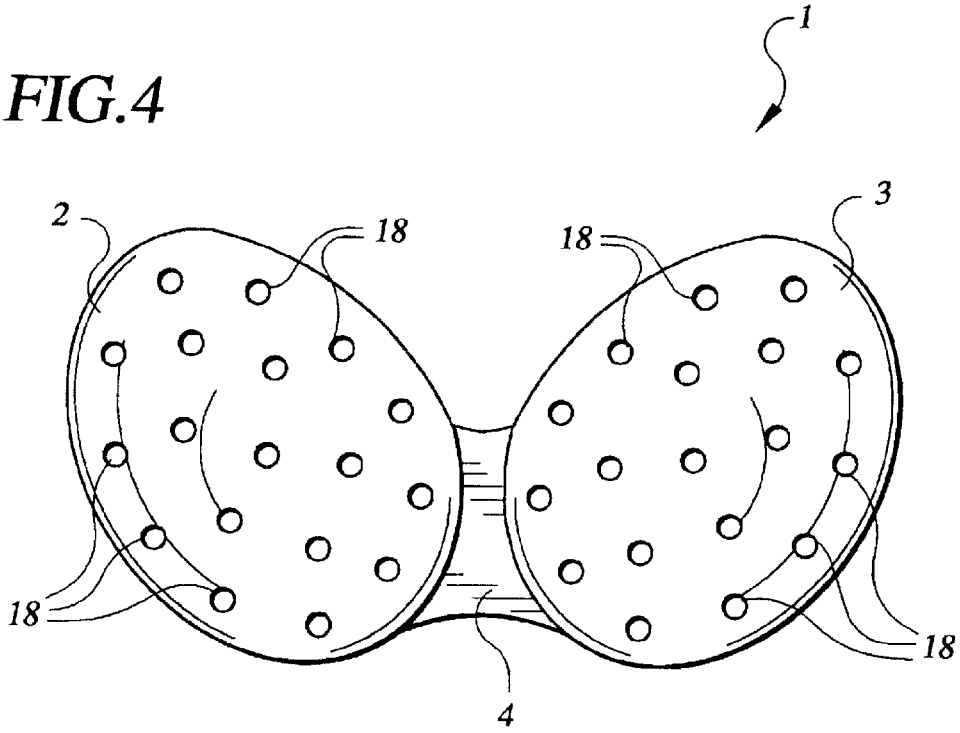
FIG. 4 is a back view of a third preferred embodiment of the bra support of the present invention.

Referring now to FIG. 4, a third preferred embodiment of the bra support of the present invention is shown. This third preferred embodiment contains a plurality of openings 18 in. the concave cup portions 2 and 3. Openings may also be present in flat portion 4. Such openings permit air circulation to and through a bra to permit drying. It will be understood that the number and size of such openings 18 may vary provided that the number of size of such openings are not so large as to cause the bra support to loose its rigidity.

Figure 5:
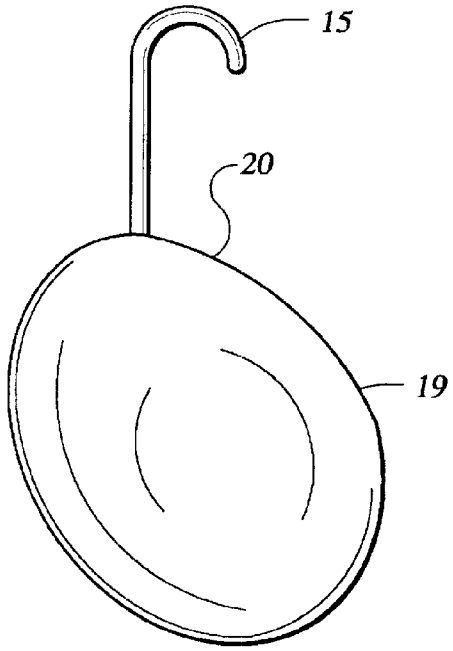
FIG. 5 is a back view of a fourth preferred embodiment of the bra support of the present invention.

Referring now to FIG. 5, a fourth preferred embodiment of the bra support of the present invention is shown in which a single concave cup portion 19 is used to support both cups of a padded bra. In this fourth embodiment, a hanging means may be attached at or near an upper edge 20 of cup portion 19. It will be understood that when a padded bra is stored using the fourth embodiment of the bra support, one cup of the bra is folded into the other bra cup and both cups are stored with the one cup portion 19.

I claim:

1. A bra support consisting of:

a cup support comprised of a left cup portion, a right cup portion and a flat portion, said flat portion extending between and connecting said left and right cup portions, said left and right cup portions each extending concavely forward of said flat portion, said left and right cup portions each substantially ovoid in shape; and bra retention means on each of said left and right cup portions.

2. The bra support of claim 1 further comprising a hanging means attached to said flat portion.

3. The bra support of claim 1 wherein said bra retention means is comprised of a first band attached across a diameter of said left cup portion and a second band attached across a diameter of said right cup portion.

4. The bra support of claim 1 wherein said bra retention means is comprised of a first clip formed as a cut out portion of said left cup portion and a second clip formed as a cut out portion of said right cup portion.

5. The bra support of claim 3 further comprising a hanging means attached to said flat portion.

6. The bra support of claim 4 further comprising a hanging means attached to said flat portion.

7. The bra support of claim 1 further comprising a plurality of openings in said left cup portion and said right cup portion.

8. The bra support of claim 2 further comprising a plurality of openings in said left cup portion and said right cup portion.

9. The bra support of claim 3 further comprising a plurality of openings in said left cup portion and said right cup portion.

10. The bra support of claim 4 further comprising a plurality of openings in said left cup portion an d said right cup portion.

11. The bra support of claim 5 further comprising a plurality of openings in said left cup portion and said right cup portion.

12. The bra support of claim 6 further comprising a plurality of openings in said left cup portion and said right cup portion.

13. A bra support consisting of:

a cup portion substantially ovoid and concave in shape; and bra retention means on said cup portion.

14. The bra support of claim 13 wherein said cup portion has an upper edge and further comprising a hanging means attached to or near said upper edge.

15. The bra support of claim 13 wherein said bra retention means is comprised of a band attached across a diameter of said cup portion.

16. The bra support of claim 13 wherein said bra retention means is comprised of a clip formed as a cut out portion of said cup portion.

17. The bra support of claim 15 further comprising a hanging means attached to said upper edge.

18. The bra support of claim 16 further comprising a hanging means attached to said upper edge.

* * * * *